US005706553A

United States Patent [19]

Riley et al.

[11] Patent Number: 5,706,553

[45] Date of Patent: Jan. 13, 1998

[54] MULTIPLE GRIP-POSITION ERGONOMIC TOOL HANDLE

[75] Inventors: Paula Riley, New York; Kenneth V. Stevens, Brooklyn, both of N.Y.

[73] Assignee: Prescient Partners, L.P., New York, N.Y.

[21] Appl. No.: 539,738

[22] Filed: Oct. 5, 1995

Related U.S. Application Data

[63] Continuation-in-part of Ser. No. 270,057, Jul. 1, 1994, Pat. No. 5,547,249.

[51] Int. Cl.[6] ..... A47L 13/022

[52] U.S. Cl. ..... 16/111 R; 15/143.1; 15/236.01; 16/DIG. 18

[58] Field of Search ..... 16/110 R, 111 R, 16/114 R, DIG. 12, DIG. 18, DIG. 19; 15/143.1, 236.02, 236.01

[56] References Cited

U.S. PATENT DOCUMENTS

| | | | |
|---|---|---|---|
| D. 142,468 | 10/1945 | Bremer | 15/236.01 |
| 3,039,126 | 6/1962 | Kessler | 16/DIG. 12 |
| 3,178,747 | 4/1965 | Peterson | 15/236.01 |
| 4,704,758 | 11/1987 | Hoffman | 16/110 R |
| 4,962,561 | 10/1990 | Hamilton | 15/111 |
| 5,398,364 | 3/1995 | Vogt | 15/236.02 |
| 5,402,550 | 4/1995 | Lessard | 15/144.2 |
| 5,455,981 | 10/1995 | Wiese | 16/110 R |
| 5,471,700 | 12/1995 | Pereira | 15/236.02 |

OTHER PUBLICATIONS

U.K. Patent Application 2,277,900 A, pub. Nov. 16, 1994, Inventor: Irwin 7 pp. spec. and 2 pp. drwgs.

*Primary Examiner*—Chuck Mah
*Assistant Examiner*—Donald M. Gurley
*Attorney, Agent, or Firm*—Notaro & Michalos P.C.

[57] ABSTRACT

A multi-grip tool has an elongated, preferably ribbon shaped handle, having multiple bends separated by grip portions. An operating part, such as a burnishing, pushing, scraping or other tool, is connected to one end of the handle. With the multiple bends, multiple hand positions are possible for holding and manipulating the tool.

6 Claims, 6 Drawing Sheets

MULTIPLE GRIP-POSITION ERGONOMIC TOOL HANDLE

CROSS REFERENCE TO RELATED APPLICATION

This is a continuation-in-part application of Ser. No. 08/270,057 filed Jul. 1, 1994, now U.S. Pat. No. 5,547,249, entitled STABILIZING DEVICE FOR USE WITH COVERS AND CUSHIONS ON SEATING AND UPHOLSTERED FURNITURE and now pending.

FIELD AND BACKGROUND OF THE INVENTION

The present invention relates in general to hand tools and, in particular, to a new and useful multi-grip-position handle, which can be comfortable and effectively used in the human hand and, in at least one position, in conjunction with the wrist and forearm.

A wide variety of hand tools have been developed throughout history. Most hand tools include a handle to be grasped by the hand or hands of the user, and what will generally be referred to here as an operating part. The operating part can be a burnishing tool, a brush, a sanding pad, a rake, a blade, a scouring pad, a cleansing pad, a roller, a scraper, a lever, a nail puller, or any other wide variety of operating parts, which must be moved by the user, through the aid of the handle which is connected to the operating part.

Among known hand tools is a brush having a handle with a single bend for reaching hard to paint areas, as well as a wrench with a bent handle.

SUMMARY OF THE INVENTION

The functional design of a tool handle can add immensely to the tool's effectiveness and to safety and comfort of the user. The present invention relates to a tool handle which achieves a unique spectrum of goals, including:

1. Long reach with successive comfortable grips, enabling the hand position to move from close distance to work contact point to longer distance from work point.

2. Two-hand grip, both hands in line with handle line.

3. Two-hand grip, front hand perpendicular to handle line, back hand in line with handle. This position is a high power, high leverage grip orientation.

4. Single handed reinforced grip by way of wrist/forearm lashing band. This allows for long term work with hand and wrist held in position to minimize fatigue and repetitive motion injury.

5. Reversible end-to-end handle for a double headed tool.

6. Invertible handle. Option to turn the tool 180 degrees to change the head orientation from downward to upward.

The unique double bend of the invention accommodates hand, wrist and forearm contours in a manner which maximizes reach, control and comfort. The invention also facilitates use by people with handicaps including arthritis and other strength or articulation impairments. This handle design is appropriate for a wide variety of tools, including: scrapers, burnishers, veneer and laminate rollers, sanding tools, brushes—including toilet, painting and other brushes, fabric and slipcover pushing and adjusting tools as in the parent application No. 08/270,057, now U.S. Pat. No. 5,547,249 spackling knives and garden tools. This list is not meant to be all inclusive of the operating part that can be used with the handle of the invention.

A further object of the invention is to provide a multi-grip-position tool, which is simple in design, rugged in construction, economical to manufacture, and extremely versatile and effective in use.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
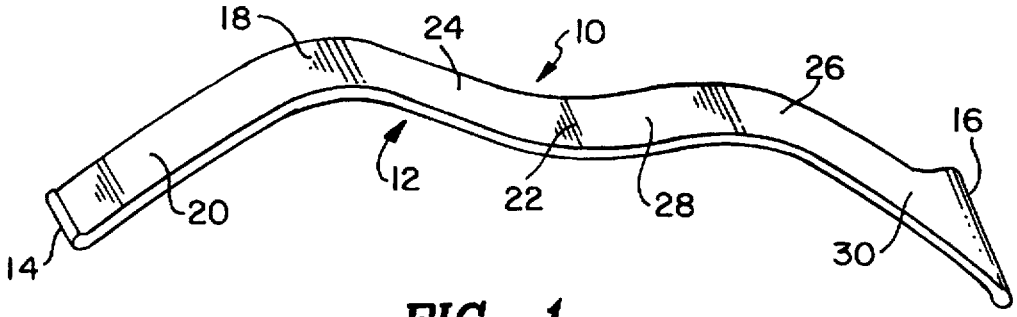
FIG. 1 is a perspective view of a double-ended burnisher tool, according to the present invention.

Referring to the drawings in particular, the invention embodied in FIG. 1 comprises a multi-grip tool generally designated 10, having an elongated handle generally designated 12 with opposite ends 14 and 16. An operating part, such as a broad rounded burnishing tool is connected to one end of the handle at 16. An additional tool, such as a narrow rounded burnishing end is also attached to the opposite end at 14 in the embodiment of FIG. 1. According to the invention, handle 12 comprises a first obtuse angle bend 18 which is spaced from the operating part 14 by a first grip portion 20, which is large enough so that it can be gripped by the hand of a user. Handle 12, also includes a second obtuse angle bend 22 which bends in an opposite direction from first angle 18, and which is spaced from the first angle 18 by a second grip portion 24. Grip portion 24 is also large enough so that it can be gripped by the hand of a user.

Handle 12 also includes a third obtuse angle bend 26, which is spaced from the second bend 22 by a third grip portion 28. Portion 30 of handle 12, which separates the third angle 26 from the second operating part 16 may be part of the second operating part or a further grip portion.

Figure 3:
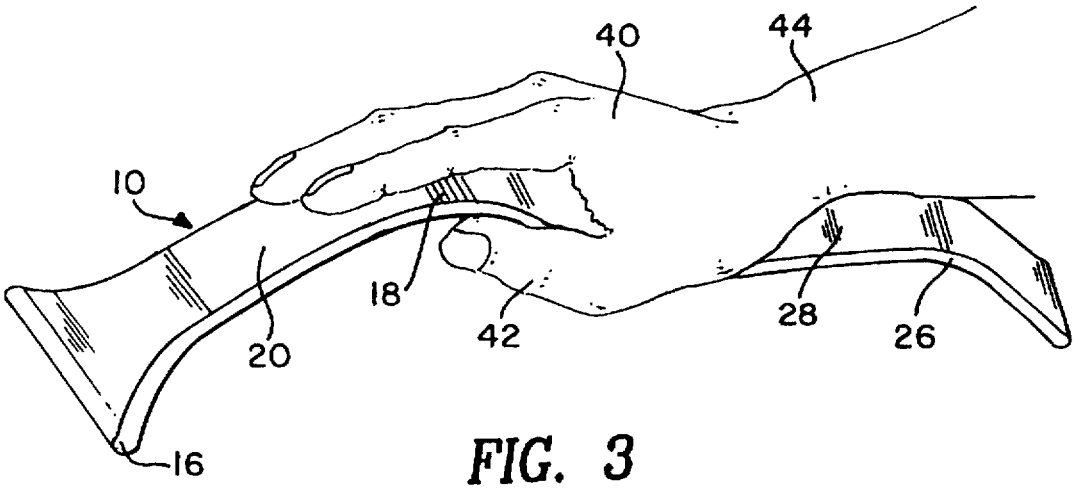
FIG. 3 is a perspective tool according to the present invention being held by a hand of a user in a forward pushing operation.

Each angle is referred to as an obtuse angle because it is meant to represent a bend in the handle of from about 90 degrees to less than 180 degrees (which would represent a straight handle). As evident in FIG. 1, two of the bends, namely the first bend 18 and the third bend 26, are in the same direction while the intermediate second bend 22 is in the opposite direction. Advantageously, one of the bends is at a greater angle than the other. Generally, the greater bend, which is bend 18 in FIG. 1, is adjacent the operating part of the tool if only a single operating part is used, or the most used operating part if both ends of the tool include operating parts. This is because the greatest leverage and availability of multiple hand positions is afforded by the large bend, while the more gentle bend is useful for engagement against the wrist. Whether one operating part or the other is more or less useful, is a matter of degree as illustrated in FIGS. 1 and 3, where the larger bend 18 in FIG. 3 is adjacent the broad burnishing tool end 16. It is noted that the same reference numerals are used throughout the drawings to designate the same or functionally similar parts.

Figure 2:
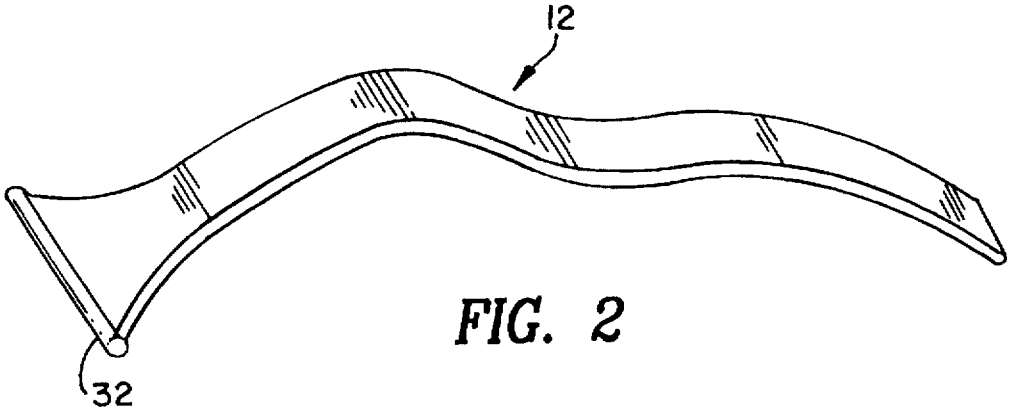
FIG. 2 is a view similar to FIG. 1 of a scraper, in particular an ice scraper tool, according to the present invention.

FIG. 2 illustrates an ice scraper 32 as the operating part connected to a tool handle 12 of the invention.

FIG. 3 illustrated how the hand 40 of the user can be in an open palm position with the thumb 42 engaged under the bend 18 and the palm bridging the first and second grip portions of the tool. The third grip portion 28 and third bend 26 form additional support surfaces for the wrist and forearm 44 of the user.

Figure 4:
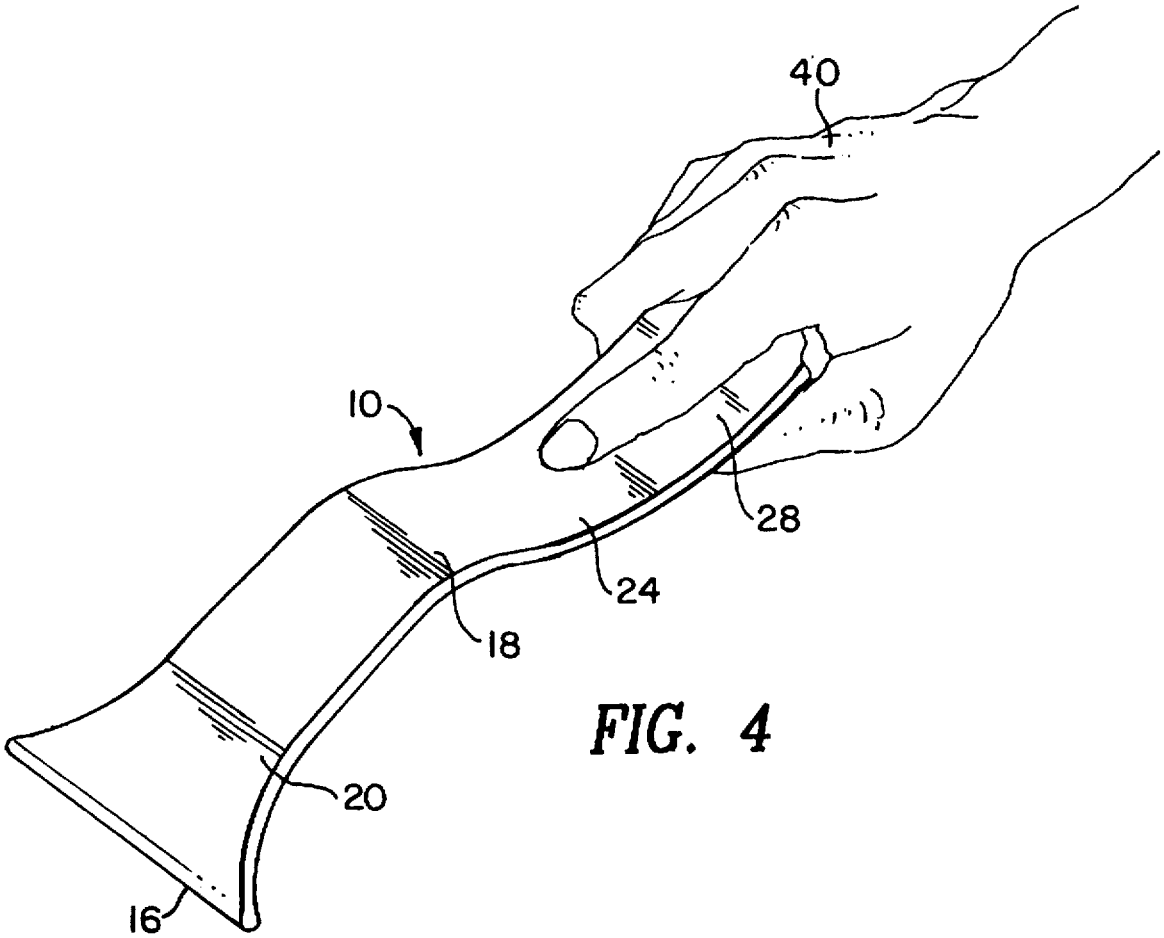
FIG. 4 is a view similar to FIG. 3 of the invention used in a rear hand position.

FIG. 4 shows a rear position of the user's hand 40 of the tool of the invention, where the third bend is embraced by the hand and the third and further grip portions are used to hold the tool. This extends the reach of the user as the hand position changes between FIGS. 3 and 4.

Figure 5:
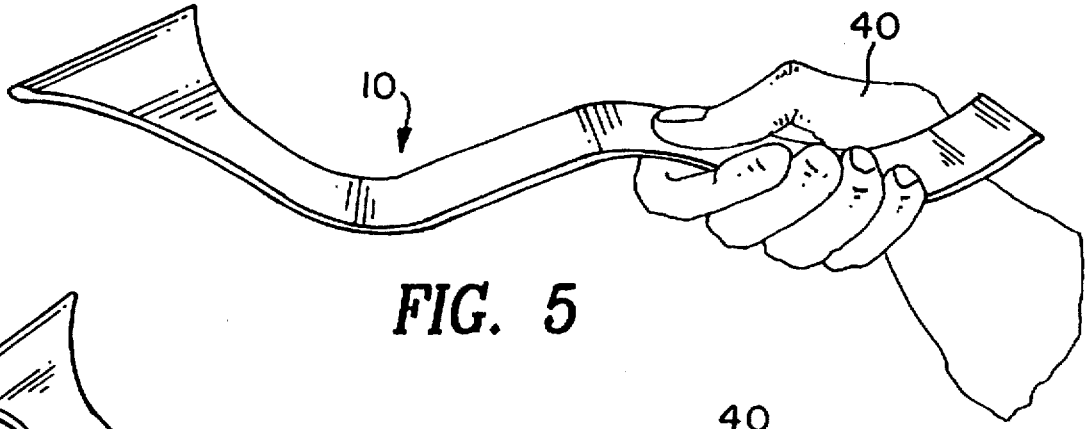
FIG. 5 is a view similar to FIG. 4, with a tool used with one hand and in one typical end inverted position.
Figure 6:
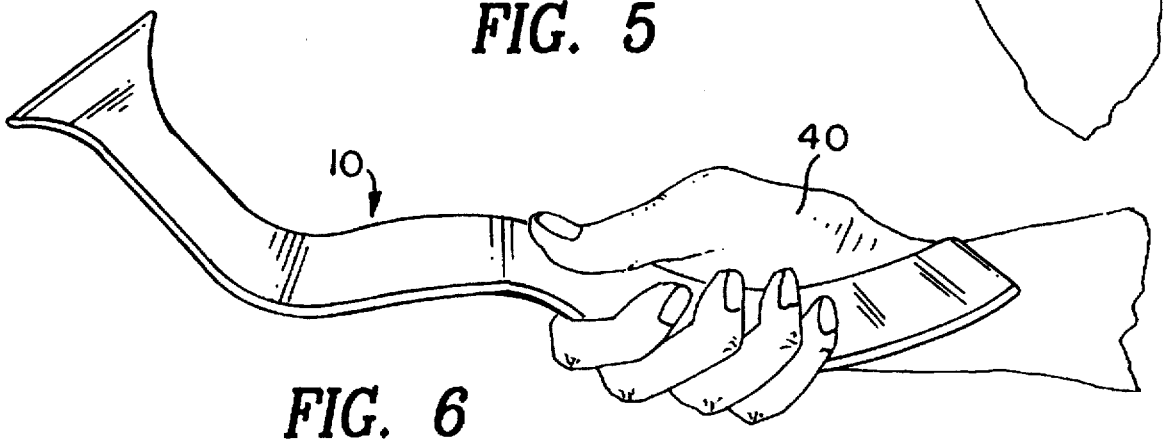
FIG. 6 is a view similar to FIG. 5, showing another inverted hand position.

The versatility of the invention is further illustrated in FIGS. 5 and 6, where the tool is inverted if needed to burnish under surfaces or to use the tool as a push tool for pushing materials at an inclined upward angle.

Figure 7:
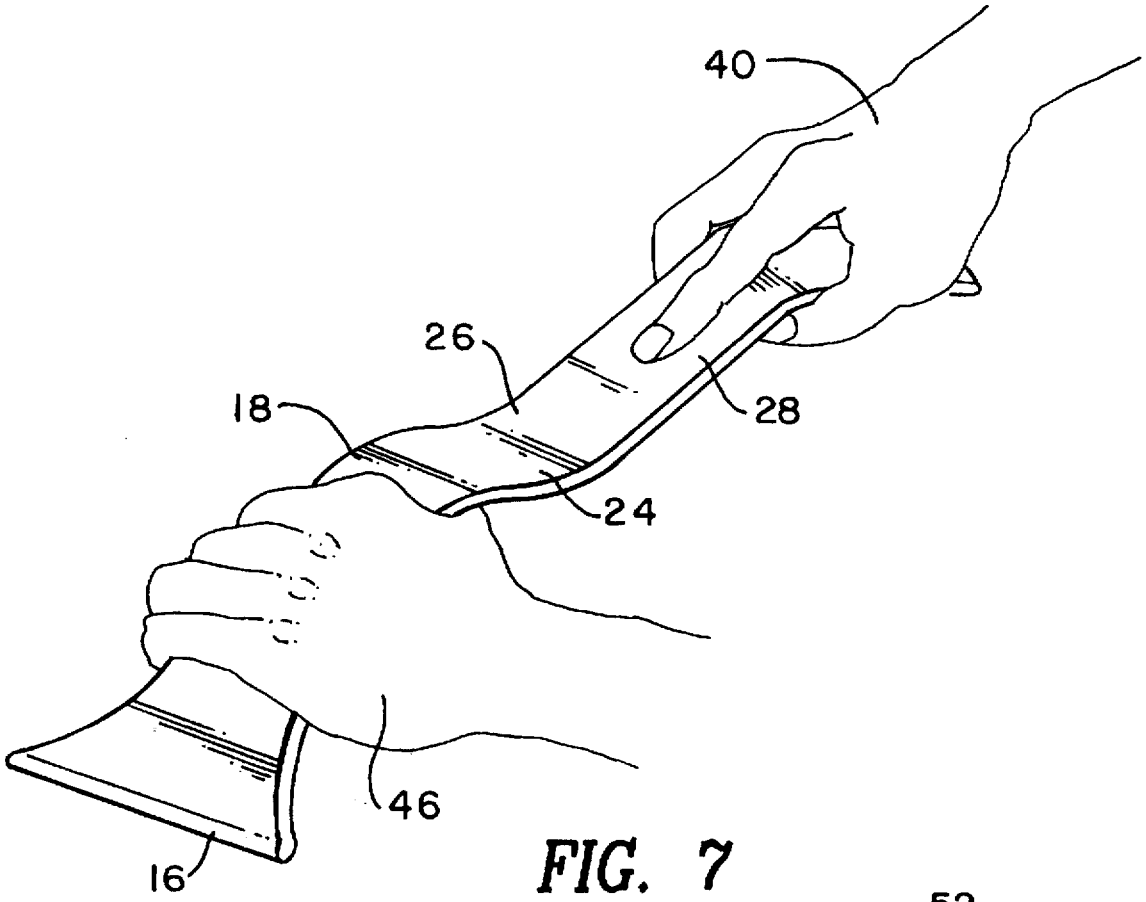
FIG. 7 is a view similar to FIG. 4, showing use of the invention with two hands.

FIG. 7 shows another way of holding the tool, namely by grasping the tool in one of the user's hands 40, in the rear position, and using the other hand 46 for grasping the forward end of the tool at the first grip of portion.

Figure 8:
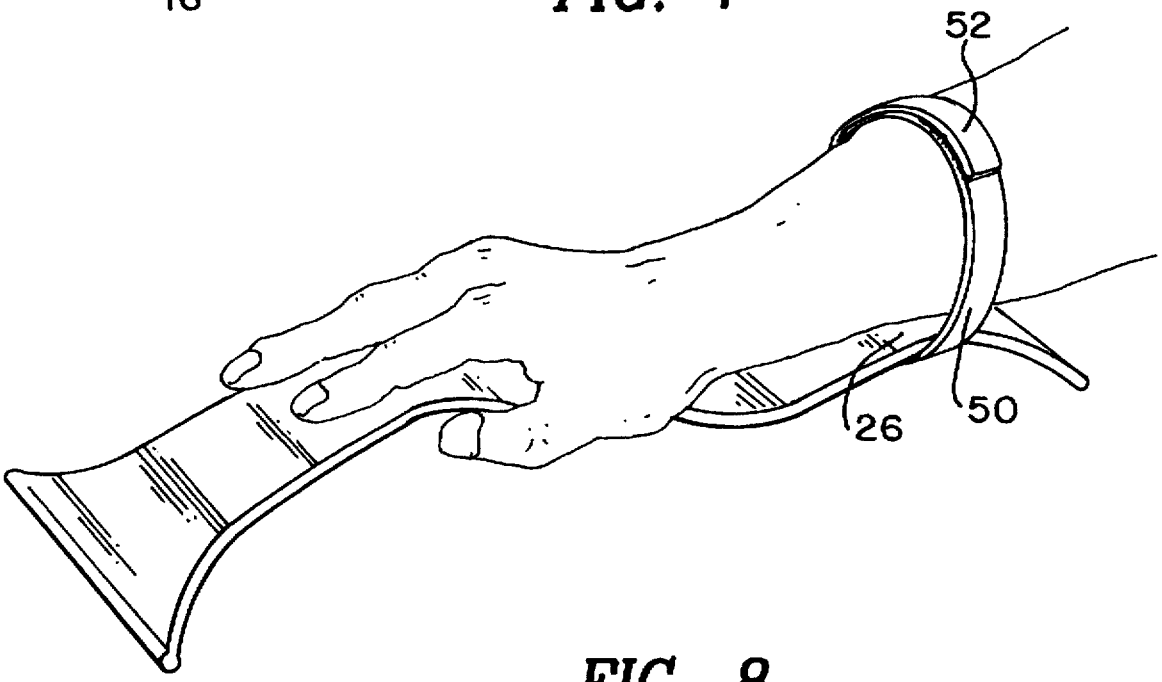
FIG. 8 is a view similar to FIG. 7, showing a one handed use of a further embodiment of the invention, which advances the cooperation of the user's wrist in the operation.

FIG. 8 shows a further embodiment of the invention, which includes a wrist or forearm strap 50 having ends 52, which can be connected, for example using hook and loop fastener tabs, for firmly holding a portion of the tool advantageously the portion having the more gentle third bend 26, against the forearm of the user.

Figure 9:
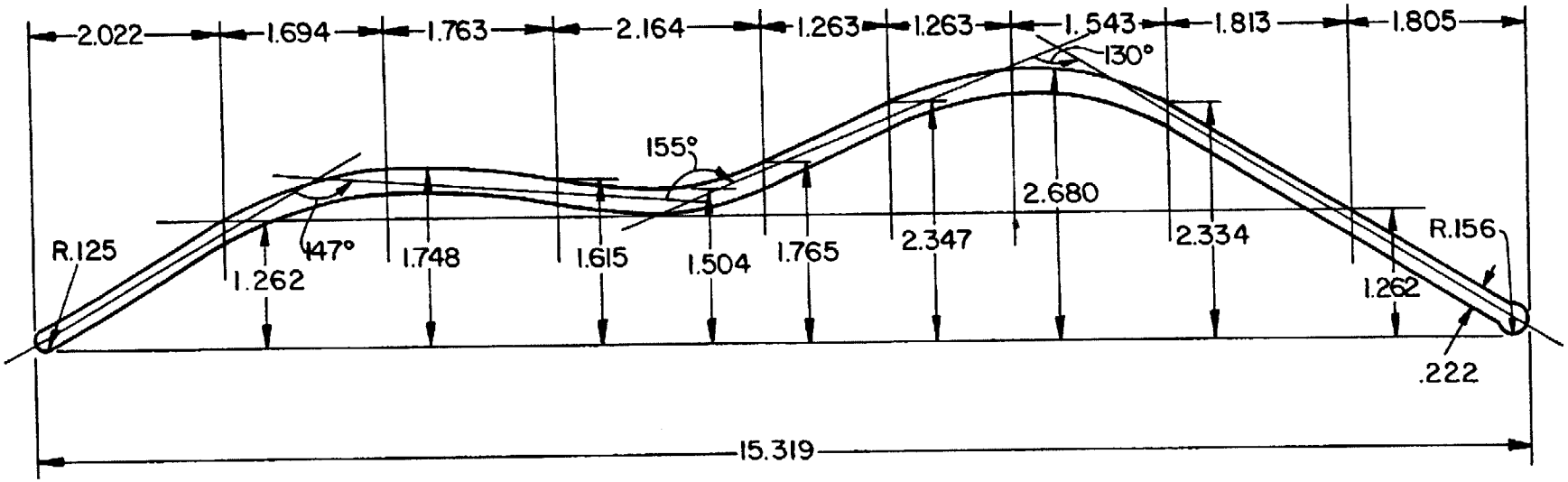
FIG. 9 is a side elevational view with typical dimensions, relationships and curvatures for the different parts of the tool and handle, according to the present invention.

FIG. 9 illustrates what is currently believed to be the best mode of the invention including typical but non-limiting dimensions and angles for the various bends of the tool handle. Although most of the grip portions have straight segments, the grip portions curve gently into the bends to help conform the tool more smoothly to the user's hand or hands and wrist and forearm portions, depending on the way the tool is being held. Advantageously, the bends are from about 90 degrees to about 170 degrees with the tightest first bend being advantageously less than 140 degrees and the more open, more gentle third bend being greater than about 140 degrees.

Figure 10:
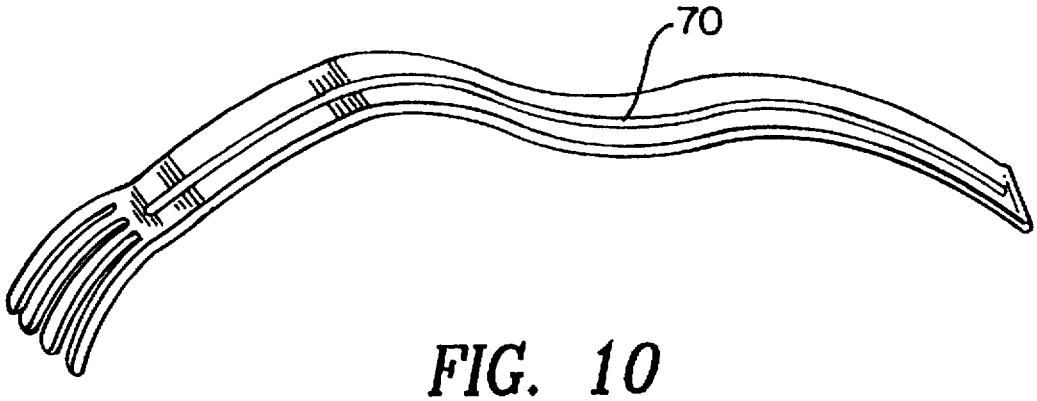
FIG. 10 is a perspective view of a hand rake or garden tool, in accordance with the present invention.
Figure 11:
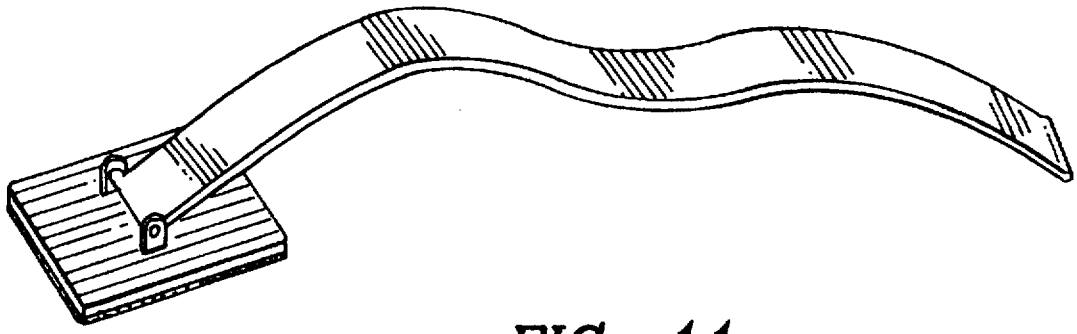
FIG. 11 is a sanding pad, according to the present invention.
Figure 12:
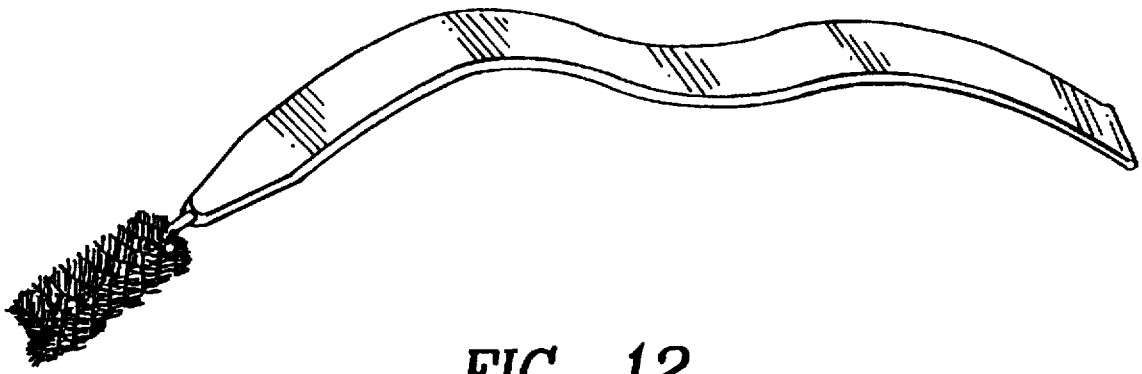
FIG. 12 is a toilet brush, in accordance with the present invention.

FIGS. 10, 11 and 12 illustrate operating parts such as a rake (FIG. 10) a sanding pad (FIG. 11) which might also be a scouring, cleansing, polishing or other pad, and a brush such as a toilet brush (FIG. 12). FIG. 10, also illustrates how the generally ribbon shaped elongated handle, which has a width across the bend that is greater than the thickness of the handle, includes a reenforcing rib 70 extending along the length of the handle. Any embodiment of the invention can be used with or without ribs depending on the material used for the handle and the strength of the tool required. The cross-section of the handle may also be oval, flat, ribbed or non-ribbed.

Figure 13:
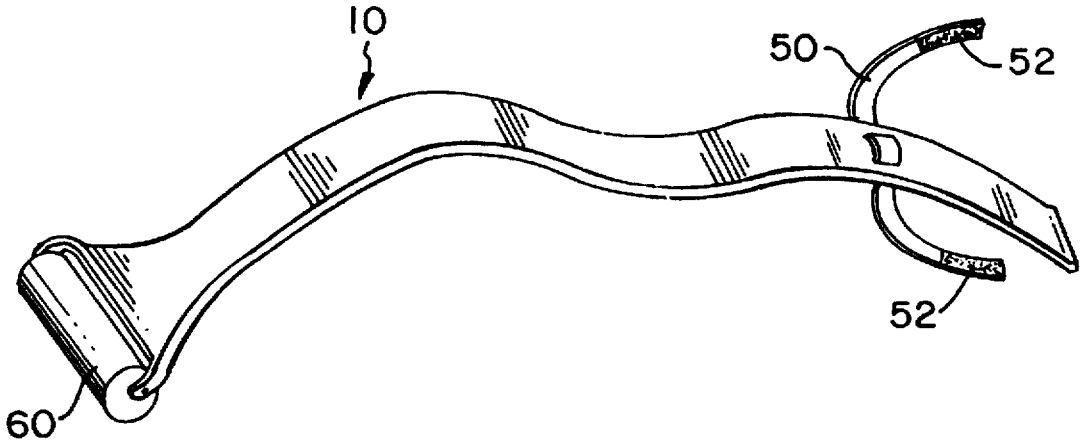
FIG. 13 is a roller with forearm band, according to a further embodiment of the invention.
Figure 14:
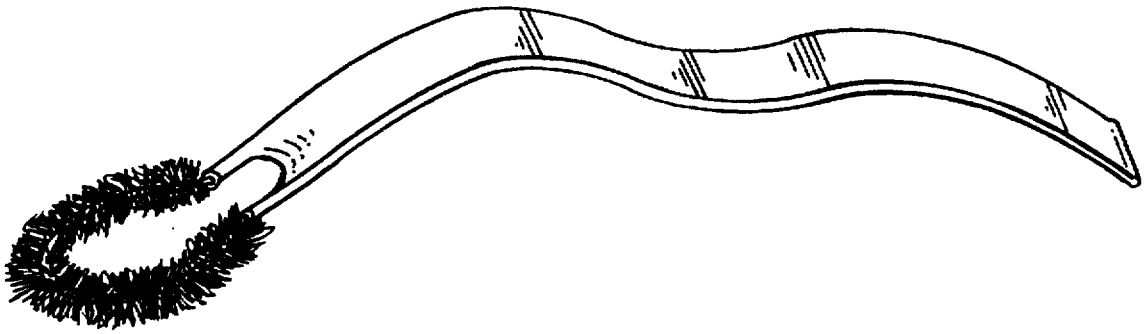
FIG. 14 is a toilet brush with malleable tip, according to the present invention.

FIG. 14 shows another embodiment of the invention where the operating part is a forked toilet brush having a malleable wire through the brush section. FIG. 13, also uses a forked operating part but in the form of a roller 60. Near the opposite end of the tool 10 and FIG. 13, the forearm strap 50 is illustrated having hook and loop pads for fastening the strap around a forearm at 52.

Materials and typical dimensions of the invention are as follow:

| Materials: |
|---|
| Plastic |
| Styrene |
| Polycarbonate |
| Polypropylene |
| ABS |
| Nylon |
| Composites |
| Carbon fiber and resin |
| Fiberglass & resin |
| Kevlar & resin |
| Wood; bend solid wood or laminated wood |
| Aluminum; bent or cast |
| Steel; bent, cast or forged |
| Dimensions: |
| Length: from 10 to 20 inches, optimal range being 13 to 18 inches. |
| Cross-section: contours can vary; oval, ribbed, etc. |
| Width: from 1 inch to 3 inches, optimal range being 1.25 to 2.25 inches |
| Thickness: from ⅛ inch to 1 inch, optimal range being ⅛ inch to ⅝ inch. |

While specific embodiments of the invention have been shown and described in detail to illustrate the application of the principles of the invention, it will be understood that the invention may be embodied otherwise without departing from such principles.

What is claimed:

1. A multiple grip-position tool comprising:

an elongated handle with opposite ends;

an operating part connected to one end of the handle;

the handle comprising a first obtuse angle bend which is spaced from the operating part by a first grip portion which is large enough so that it can be gripped by a hand of a user, a second obtuse angle bend which bends in an opposite direction from the first bend and which is spaced from the first bend by a second grip portion, the second grip being large enough so that it can be gripped by the hand of a user, and a third grip portion between the second bend and the opposite end of the handle;

a third obtuse angle bend in the third grip portion and between the opposite end of the handle and the second bend, the third bend being in the same direction as the first bend; and the elongated handle having a width across each bend which is greater than a thickness of the handle, so that the handle forms a ribbon shape, the handle being from about 10 to about 20 inches long, and having a thickness of about 1/16 of an inch to about 1 inch and a width of about 1 to 3 inches, each bend being within the range of about 90 to 170 degrees, the first bend being greater than the third bend.

2. A tool according to claim 1, wherein the handle is made of synthetic or natural material.

3. A tool according to claim 1, wherein the operating part comprises at least one of a burnishing tool, scraping tool, brushing tool, rolling tool, rubbing pad and rake.

4. A tool according to claim 1, including a forearm strap connected to the third grip portion for engagement around a forearm of a user of the tool.

5. A multiple grip-position tool comprising:

an elongated handle with opposite ends;

an operating part connected to one end of the handle;

the handle comprising a first obtuse angle bend which is spaced from the operating part by a first grip portion which is large enough so that it can be gripped by a hand of a user, a second obtuse angle bend which bends in an opposite direction from the first bend and which is spaced from the first bend by a second grip portion, the second grip being large enough so that it can be gripped by the hand of a user, and a third grip portion between the second bend and the opposite end of the handle;

a third obtuse angle bend in the third grip portion and between the opposite end of the handle and the second bend, the third bend being in the same direction as the first bend; and the elongated handle having a width across each bend which is greater than a thickness of the handle, so that the handle forms a ribbon shape; and a forearm strap connected to the third grip portion for engagement around a forearm of a user of the tool.

6. A tool according to claim 1, wherein the ribbon shaped handle has a thickness of between about 1/8 and 5/8 inches.

* * * * *